US011133607B2

(12) United States Patent
Muth et al.

(10) Patent No.: US 11,133,607 B2
(45) Date of Patent: Sep. 28, 2021

(54) ELECTRICAL CONNECTION ASSEMBLY, METHOD OF ELECTRICALLY CONNECTING A CONDUCTOR OF A CABLE WITH A METALLIC TEXTILE

(71) Applicants: TE Connectivity Germany GmbH, Bensheim (DE); Tyco Electronics Belgium EC BVBA, Oostkamp (BE); Tyco Electronics UK Ltd., Swindon (GB); TE Connectivity India Private Limited, Karnataka (IN); TE Connectivity Corporation, Berwyn, PA (US)

(72) Inventors: Christopher Muth, Langen (DE); Jens Nickel, Weinheim (DE); Jan Van Cauwenberge, Aalter (DE); Vinayakumar Shettar, Bagalakot (IN); John Marsh, London (GB); John Mark Myer, Millersville, PA (US)

(73) Assignees: TE Connectivity Germany GmbH, Bensheim (DE); Tyco Electronics Belgium EC BVBA, Oostkamp (BE); Tyco Electronics UK Ltd., Swindon (GB); TE Connectivity India Private Limited, Karnataka (IN); TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 16/863,448

(22) Filed: Apr. 30, 2020

(65) Prior Publication Data

US 2020/0350701 A1 Nov. 5, 2020

(30) Foreign Application Priority Data

Apr. 30, 2019 (EP) ..... 19171729

(51) Int. Cl.
*H01R 4/18* (2006.01)
*H01R 43/048* (2006.01)

(52) U.S. Cl.
CPC ..... *H01R 4/184* (2013.01); *H01R 43/048* (2013.01)

(58) Field of Classification Search
CPC ..... H01R 4/184; H01R 4/18; H01R 4/185; H01R 43/048; H05K 1/038; D03D 1/0082;
(Continued)

(56) References Cited

U.S. PATENT DOCUMENTS 3,648,224 A 3/1972 McDonough
4,142,771 A 3/1979 Barnes et al.
(Continued)

FOREIGN PATENT DOCUMENTS

JP 2009245614 A 10/2009
JP 2012069449 A 4/2012
(Continued)

OTHER PUBLICATIONS

Extended European Search Report, Application No. 19171729.7, dated Oct. 21, 2019, 8 pages.
(Continued)

*Primary Examiner* — Timothy J Thompson
*Assistant Examiner* — Amol H Patel
(74) *Attorney, Agent, or Firm* — Barley Snyder

(57) ABSTRACT

An electrical connection assembly includes a cable having a conductor, a metallic textile in electrical contact with the conductor, and a crimp element creating a pressure between the conductor and the metallic textile.

14 Claims, 10 Drawing Sheets

(58) Field of Classification Search
CPC ..... H05B 2203/026; H05B 2203/015; H05B 3/345; H05B 3/347; H05B 3/03
See application file for complete search history.

(56) References Cited

U.S. PATENT DOCUMENTS

| | | | | |
|---|---|---|---|---|
| 5,118,313 | A | 6/1992 | Delalle | |
| 5,735,981 | A | 4/1998 | Winfield | |
| 9,711,872 | B2 | 7/2017 | Sato | |
| 2001/0025846 | A1* | 10/2001 | Kochman | H05B 3/342 219/545 |
| 2010/0258334 | A1* | 10/2010 | Akaike | H05B 3/347 174/126.1 |
| 2012/0156926 | A1* | 6/2012 | Kato | D03D 3/005 439/502 |
| 2012/0178289 | A1 | 7/2012 | Holliday | |
| 2013/0130569 | A1 | 5/2013 | Sato | |
| 2013/0273787 | A1 | 10/2013 | Mitose | |
| 2016/0359244 | A1 | 12/2016 | Tachibana | |
| 2017/0005417 | A1 | 1/2017 | Aoki | |
| 2018/0109011 | A1* | 4/2018 | de la Garza Fernandez | H01R 43/048 |
| 2018/0175574 | A1 | 6/2018 | Kihara | |

FOREIGN PATENT DOCUMENTS

| | | | |
|---|---|---|---|
| JP | 2012248406 | A | 12/2012 |
| JP | 2015043296 | A | 3/2015 |
| JP | 2015201259 | A | 11/2015 |
| WO | 9000819 | A1 | 1/1990 |
| WO | 2011096526 | A1 | 8/2011 |

OTHER PUBLICATIONS

Abstract of JP 2012069449, dated Apr. 5, 2012, 1 page.
English translation of JP2012248406, dated Dec. 13, 2012, 16 pp.
Extended European Search Report, dated Sep. 23, 2020, 7 pages.

* cited by examiner

ELECTRICAL CONNECTION ASSEMBLY, METHOD OF ELECTRICALLY CONNECTING A CONDUCTOR OF A CABLE WITH A METALLIC TEXTILE

CROSS-REFERENCE TO RELATED APPLICATION

This application claims the benefit of the filing date under 35 U.S.C. § 119(a)-(d) of European Patent Application No. 19171729.7, filed on Apr. 30, 2019.

FIELD OF THE INVENTION

The present invention relates to an electrical connector assembly and, more particularly, to an electrical connector assembly including a metallic textile.

BACKGROUND

Electrical connection assemblies can, for example, be used in heating systems of automobiles. Such heating systems can comprise mat-like flexible electrical heating elements with a metallic textile for resistive heating. In current solutions it is, however, difficult to make an electrical connection to these heating elements.

SUMMARY

An electrical connection assembly includes a cable having a conductor, a metallic textile in electrical contact with the conductor, and a crimp element creating a pressure between the conductor and the metallic textile.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
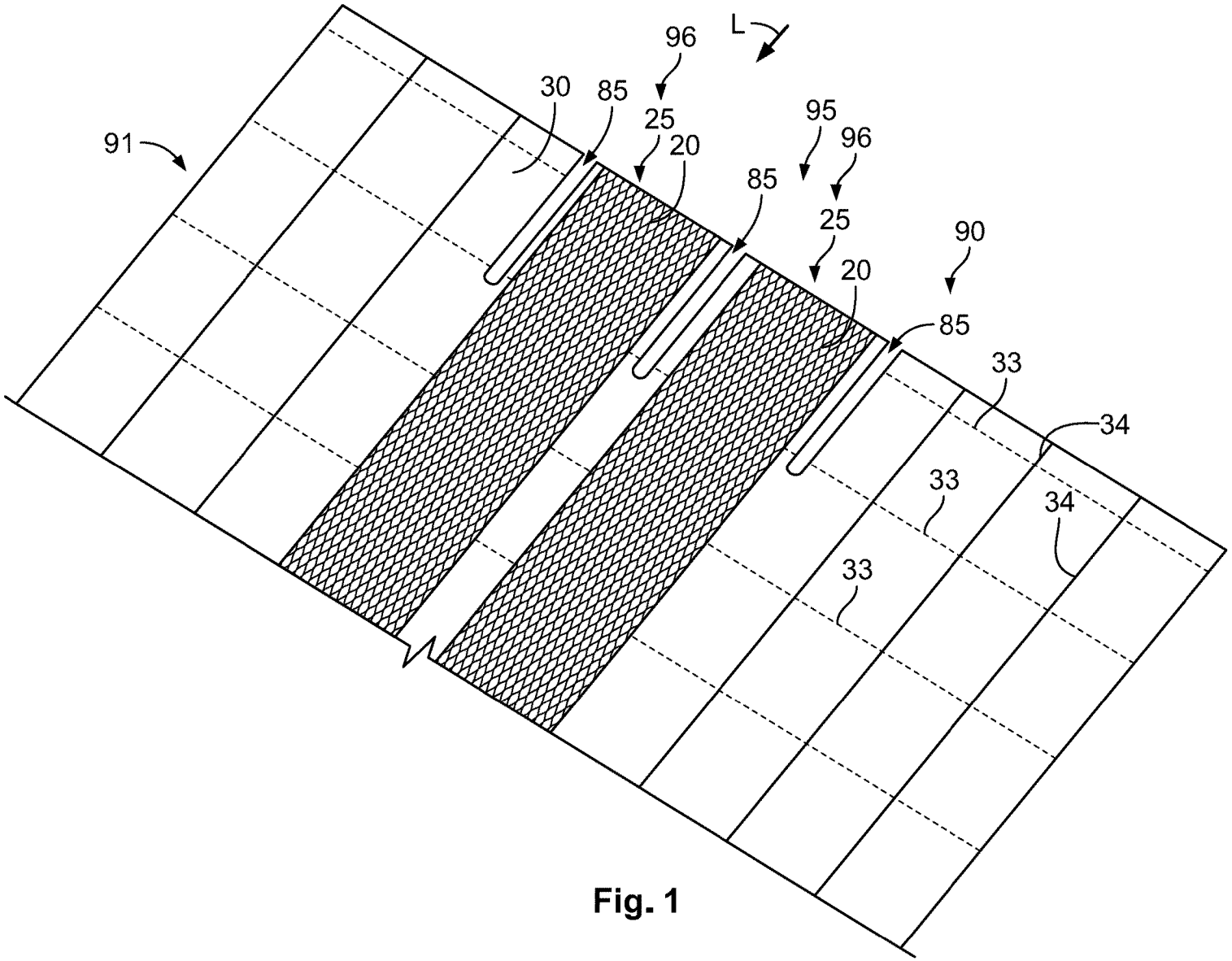
FIG. 1 is a perspective view of a first step of a method of electrically connecting a conductor of a cable with a metallic textile.

The invention will now be described in greater detail and in an exemplary manner using embodiments with reference to the drawings, wherein like reference numerals refer to like elements. The described embodiments are only possible configurations, and the individual features as described herein can be provided independently of one another or can be omitted.

A method of electrically connecting a conductor 11 of a cable 10 with a metallic textile 20 is shown in FIGS. 1-4.

The metallic textile 20, as shown in FIG. 1, can be a part of a contact section 95 of an electrical element 90, for example, an electrical heating element 91 or a flexible electrical conduction element. The contact section 95 can include a pair of contact areas 96, one for a ground connection and one for a voltage connection. Each of the contact areas 96 is strip-shaped in the shown embodiment.

The metallic textile 20 is located on an insulating textile 30, as shown in FIG. 1. The metallic textile 20 and the insulating textile 30 can be mechanically interconnected, for example, by being interwoven, to increase stability. The metallic textile 20 and the insulating textile 30 can be woven, knitted or produced in a similar manner to achieve a two-dimensional fabric or cloth. The metallic textile 20 can be a woven textile to allow an easy production. In an alternative, the metallic textile 20 can be a knitted textile to achieve a high flexibility. Other possibilities of creating a textile with a two-dimensional structure from fibers such as crocheting, knotting, felting, braiding or another technology are also possible.

In an embodiment, as shown in FIG. 1, further conductive threads like conductors 33 and heating threads 34 can be woven into the insulating textile 30. In an embodiment, the metallic textile 20 is a functional area of the electrical heating element 91.

In FIG. 1, a first step of the method has been performed. Slits 85 have been cut into the insulating textile 30 along a longitudinal direction L in order to give a pair of end parts 25 of the conducting metallic textile 20 movability.

Figure 2:
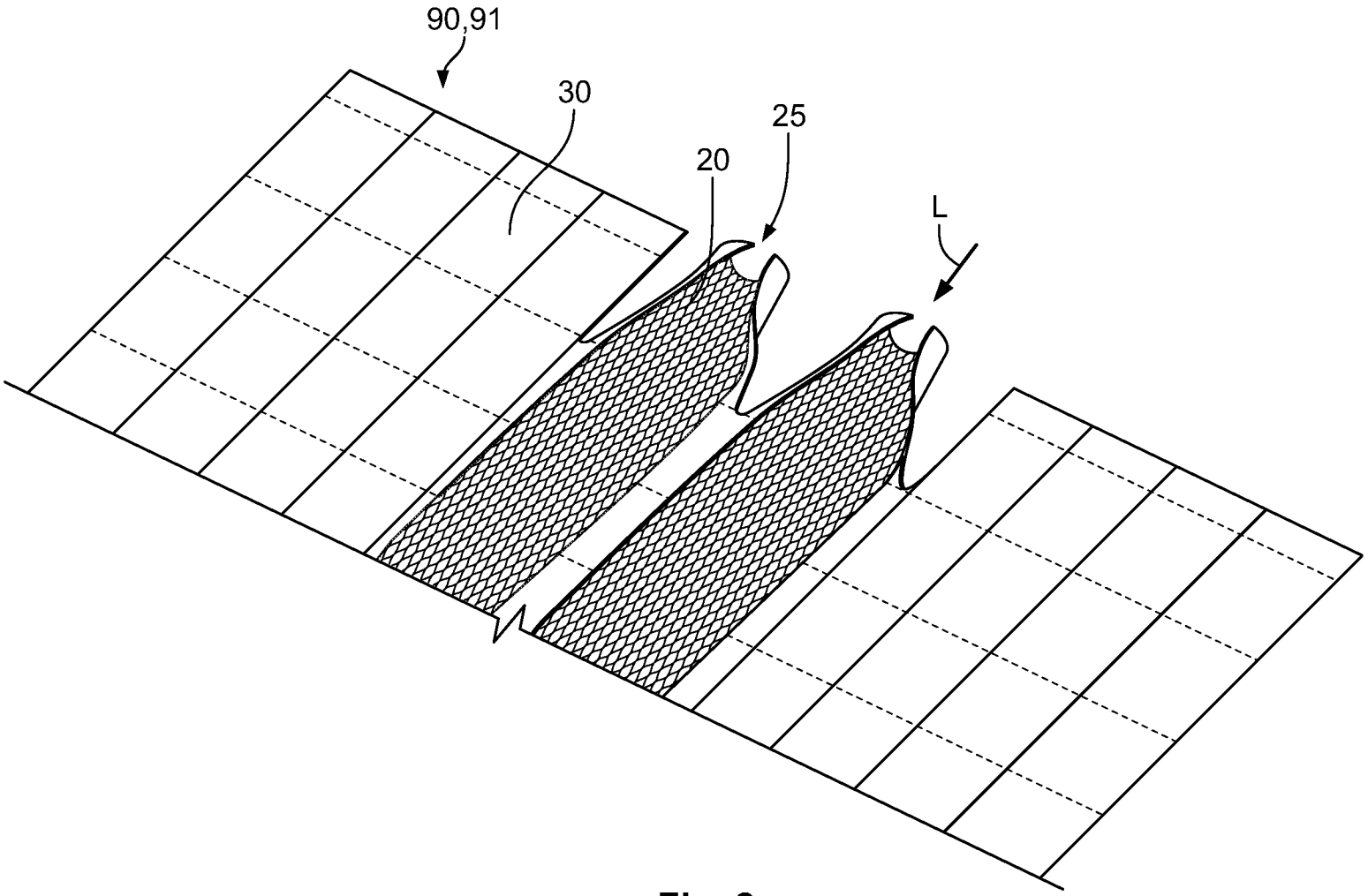
FIG. 2 is a perspective view of a second step of the method.

In a second step shown in FIG. 2, the end parts 25 are deformed sideways so that they at least partially form a basically circular or cylindrical cross section.

Figure 3:
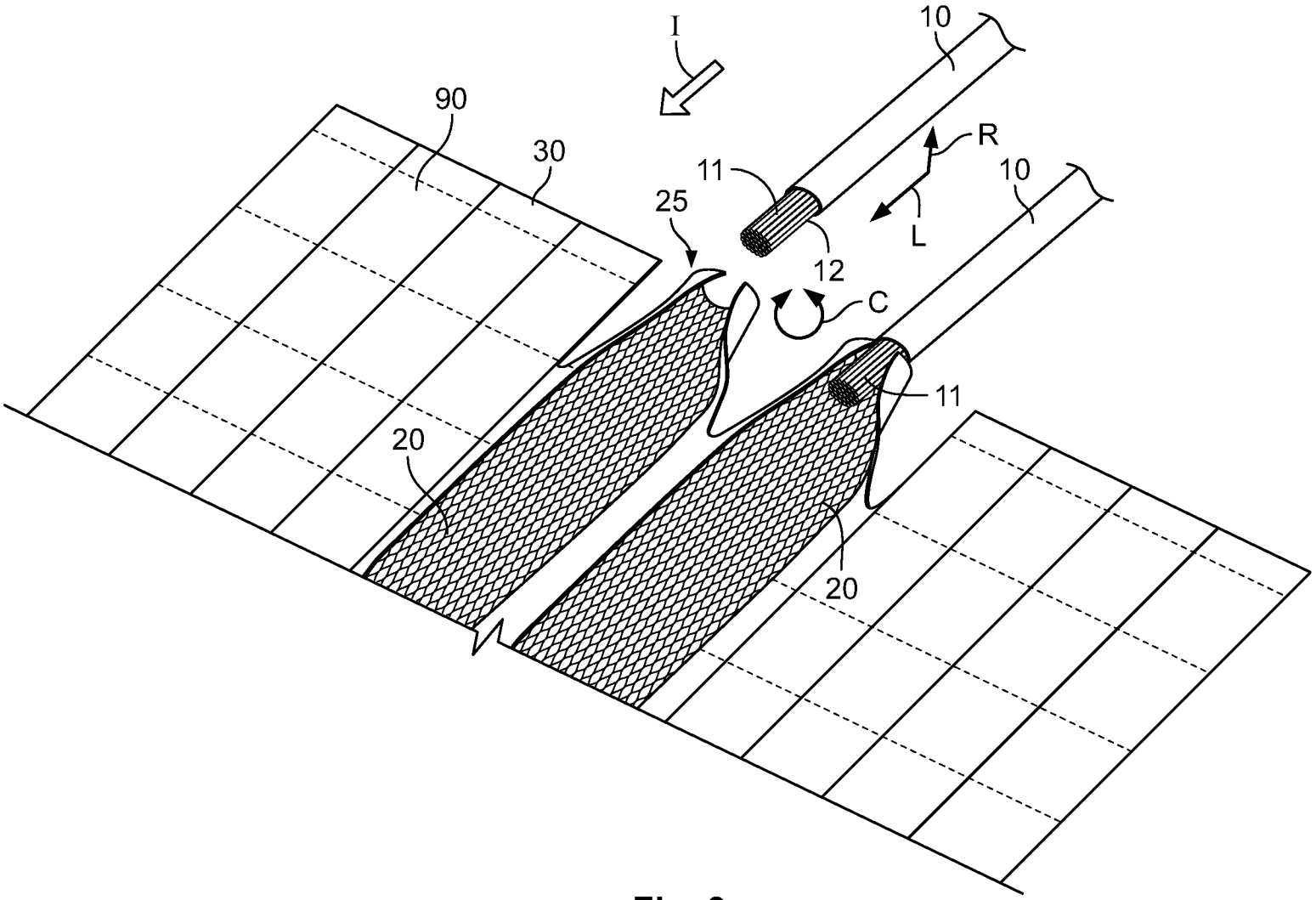
FIG. 3 is a perspective view of a third step of the method.

In a third step shown in FIG. 3, a cable 10 with a conductor 11 is inserted along the insertion direction I, which is parallel to the longitudinal direction L, into the end parts 25 in the cylindrical shape, so that the end parts 25 surround the conductor 11 along a circumferential direction C. At an outer side of the end parts 25, the insulating textile 30 is present.

Figure 4:
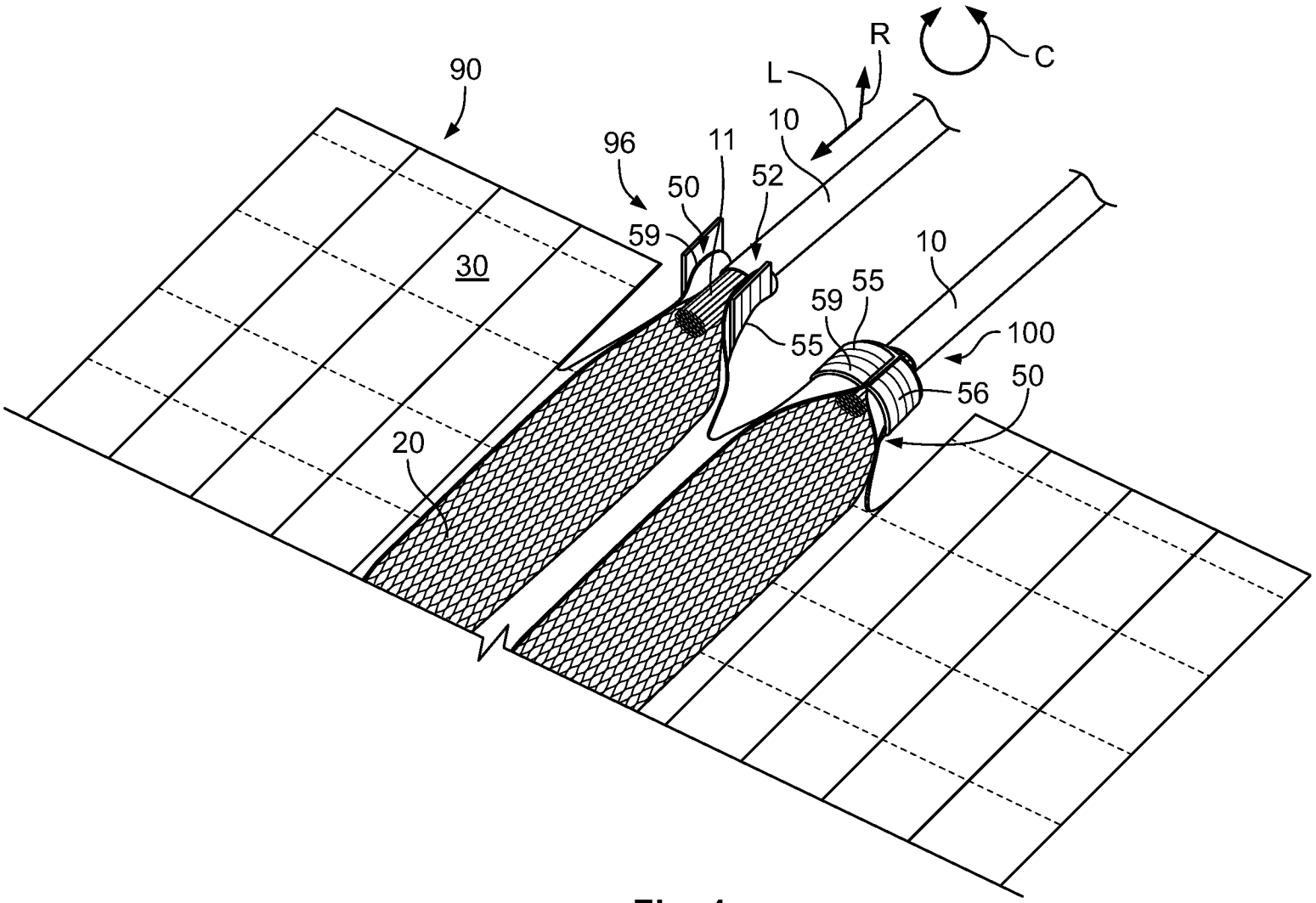
FIG. 4 is a perspective view of a fourth step of the method.

FIG. 4 shows a fourth step in which each of the end parts 25 is inserted into a crimp element 50, in particular into a receptacle 52 formed by the crimp element 50. Subsequently, the crimp element 50, a crimp section 55 in an embodiment, is deformed so that it surrounds the conductor 11, the metallic textile 20, and the insulating textile 30. The crimp section 55 is then closed along the circumferential direction C and creates a press fit between the conductor 11 and the metallic textile 20 so that a reliable electrical contact is achieved between the two.

Figure 5:
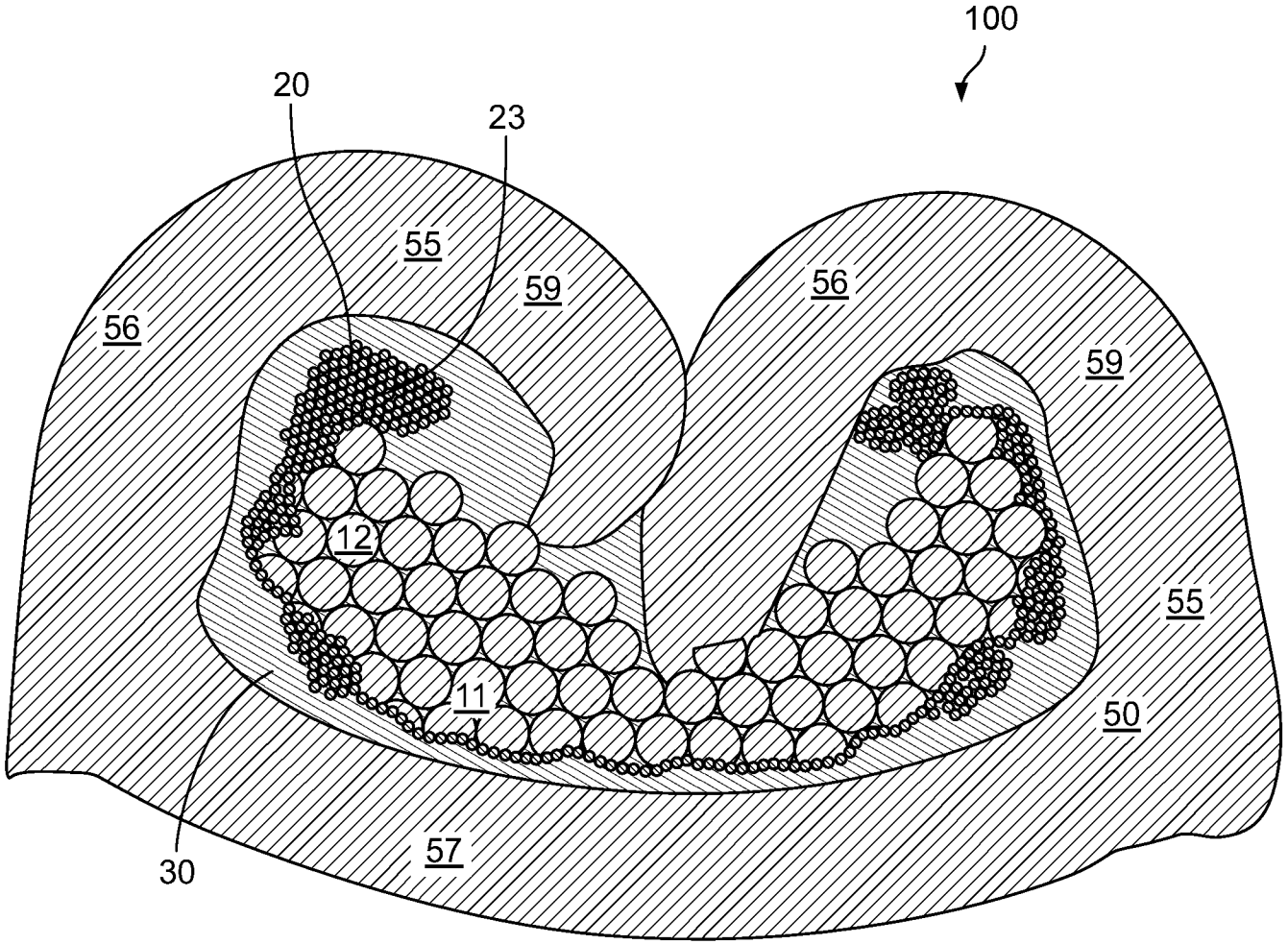
FIG. 5 is a sectional end view through an electrical connection assembly formed by the method.

An electrical connection assembly 100 created by the method of FIGS. 1-4 is shown in FIG. 5. The crimp elements 50, at the crimp section 55, can have a C-shaped cross-section, at least in a state before it is deformed, in order to achieve the electrical connection. The crimp section 55 has a pair of legs 59 embodied as crimp flanks 56 attached to a base 57. The crimp section 55 defines a volume in which the electrical conductor 11, the metallic textile 20, and the insulating textile 30 are located. The crimp element 50 creates an indirect press fit between the conductor 11 and the metallic textile 20 through the insulating textile 30.

The conductor 11 has a plurality of single strands 12 in the embodiment shown in FIG. 5 but could, in another embodiment, have only one thick wire or strand 12. Similarly, the metallic textile 20 has a plurality of threads 23 which can be made from metal or comprise metal, for example, in the form of a coating.

In the embodiment shown in FIG. 5, the insulating textile 30 is located between the metallic textile 20 and the crimp element 50. The insulating textile 30 can, for example, serve as a force-transmitting element for transmitting the pressing force from the crimp element 50 to the connection between the metallic textile 20 and the conductor 11. The insulating textile 30 can also help to distribute the forces better and to avoid localized force peaks which might cause damage.

In another embodiment, the insulating textile 30 could be located between the conductor 11 and the metallic textile 20. An electrical connection can be present between the metallic textile 20 and the crimp element 50. The crimp element 50 can then contact the conductor 11 at a different location away from the connection.

Figure 6:
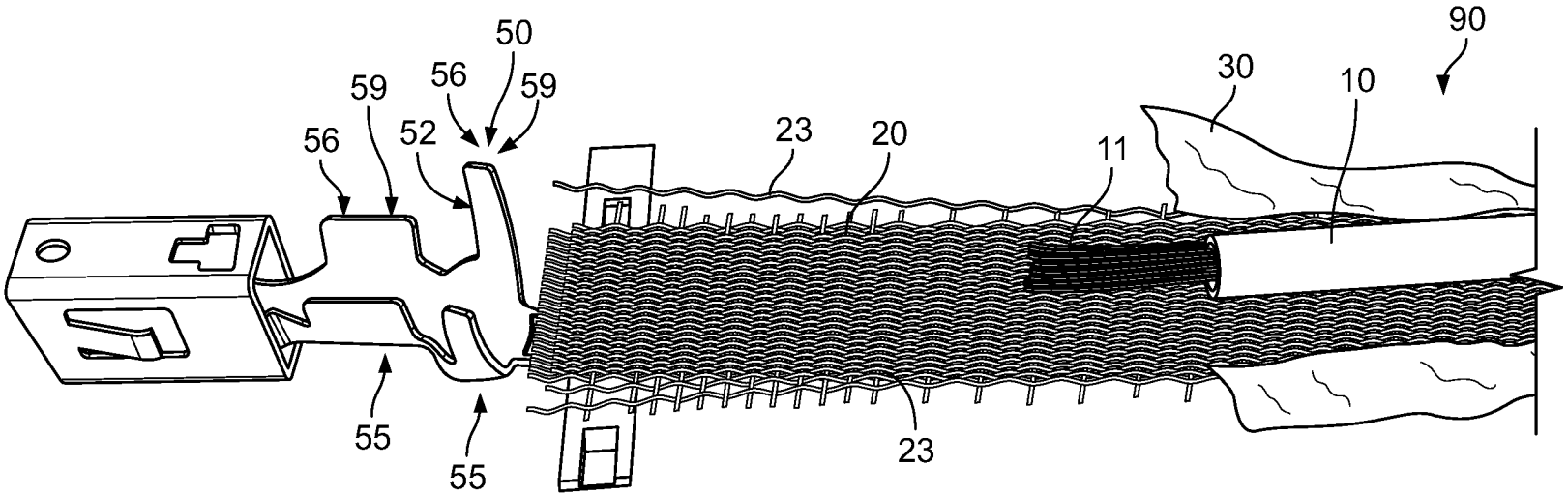
FIG. 6 is a perspective view of an electrical connection assembly produced by another method.

In another embodiment shown in FIG. 6, the insulating textile 30 has been removed partially from the electrical element 90. Through this, a direct pressing connection between the crimp section 55 of the crimp element 50, the metallic textile 20, and the conductor 11 can be achieved. This can lead to a low resistance and high conductivity of the electrical connection assembly 100. The insulating textile 30 can, for example, be removed by cutting or by applying heat.

Figure 7:
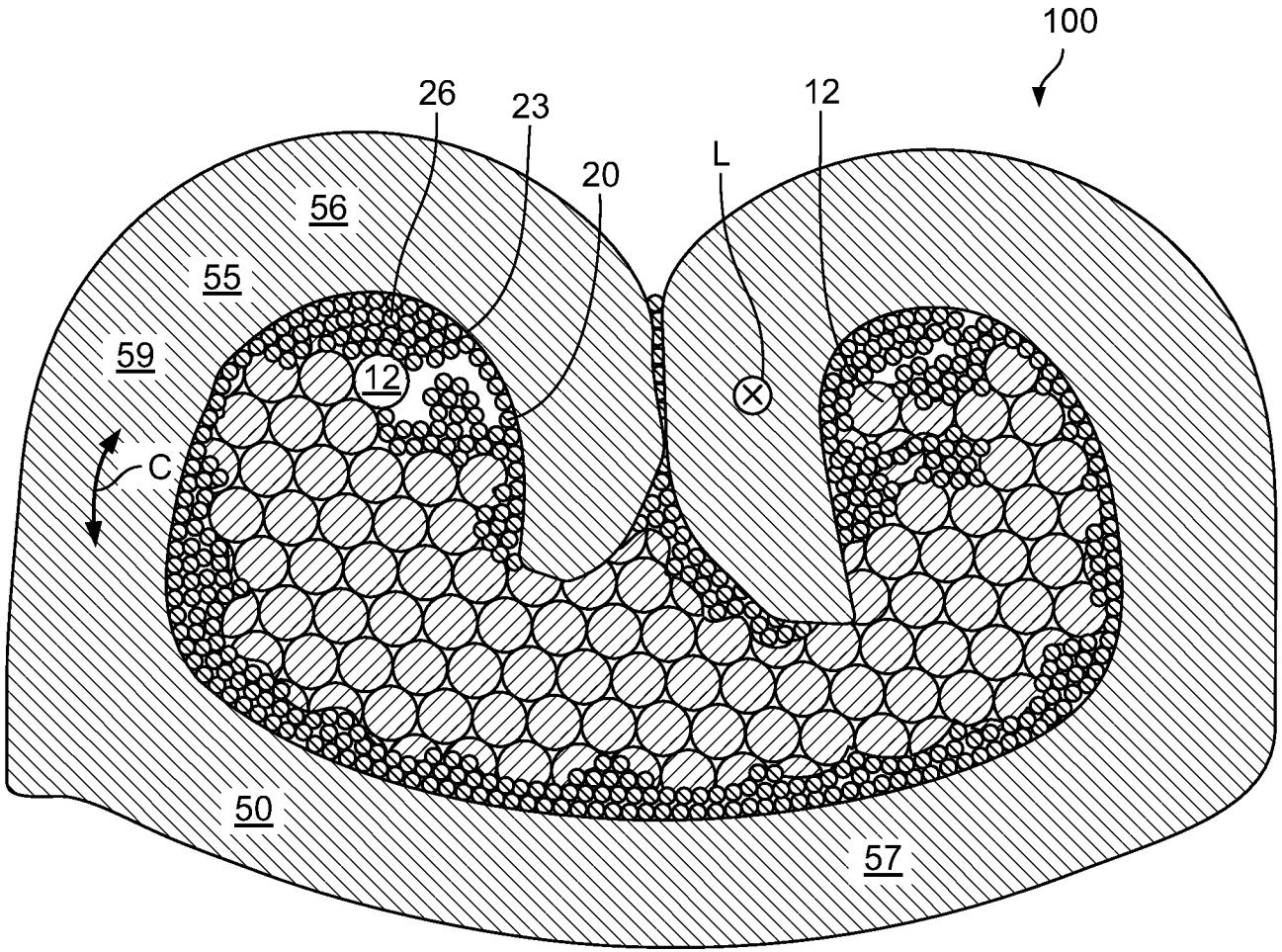
FIG. 7 is a sectional end view through the electrical connection assembly of FIG. 6.

In FIG. 7, a cross-section through an electrical connection assembly 100 created from the components in FIG. 6 is shown. It can be seen that the strands 12 of the connector 11, the threads 23 of the metallic textile 20 and the crimp element 50 are in direct electrical and mechanical contact. Again, the crimp section 55 is closed along the circumferential direction C. Two legs 59 or crimp flanks 56 have been bent towards each other so that their ends contact. The plastic deformation of the crimp section 55 with a high force results in a pressing force that remains even after the active deformation step and creates constant pressure afterwards.

Figure 8:
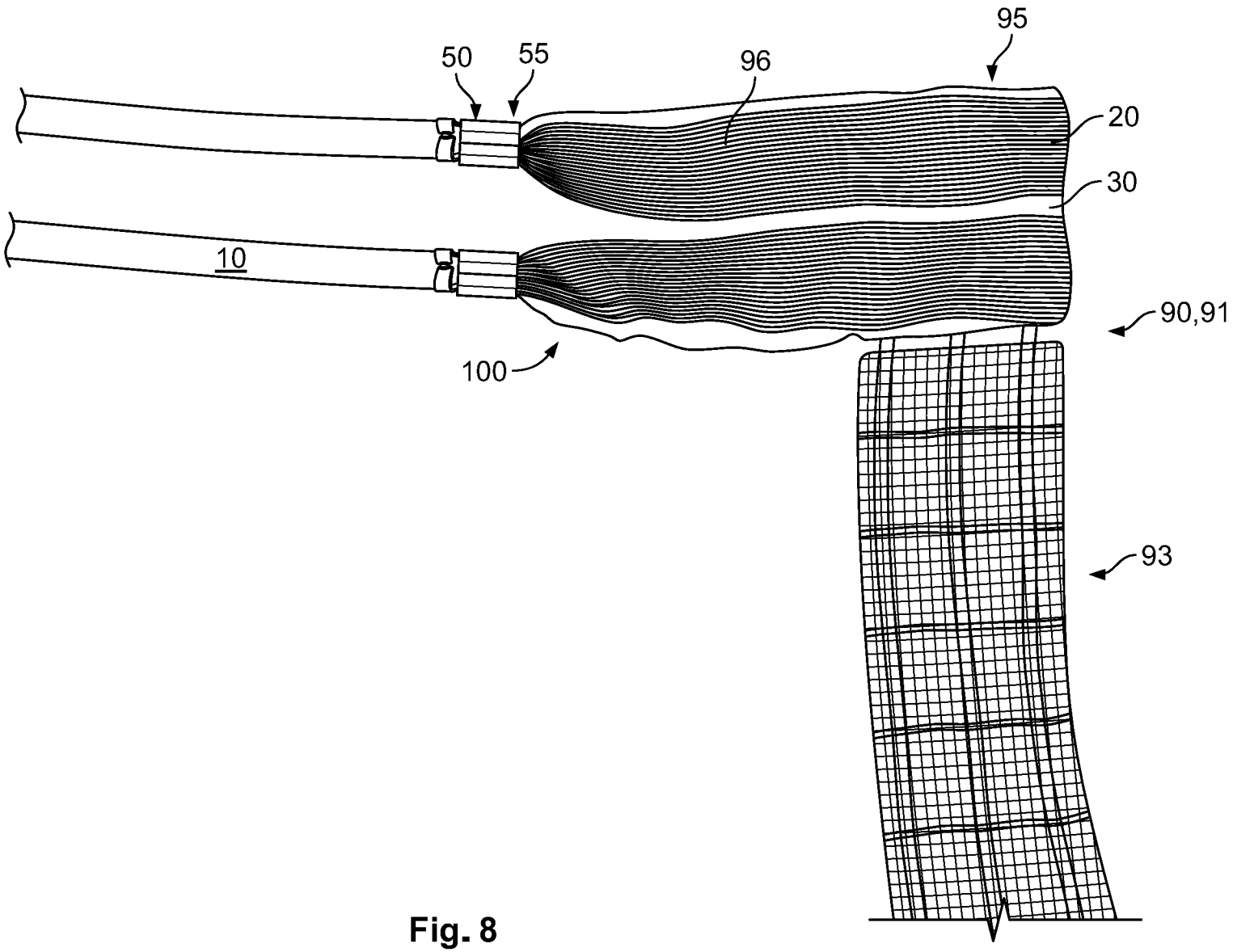
FIG. 8 is a perspective view of an electrical connection assembly including a heating section.

FIG. 8 shows the electrical element 90 in the form of the electrical heating element 91. The electrical element 90 comprises a heating section 93 that is electrically connected to the contact area 96 to which in turn the cables 10 are attached. In the contact area 96, two strips of metallic textile 20 are present, both being located on top of an insulating textile 30. The metallic textile 20 is attached to the cables 10 via crimp elements 50. This allows an easy connection to be made.

Figure 9:
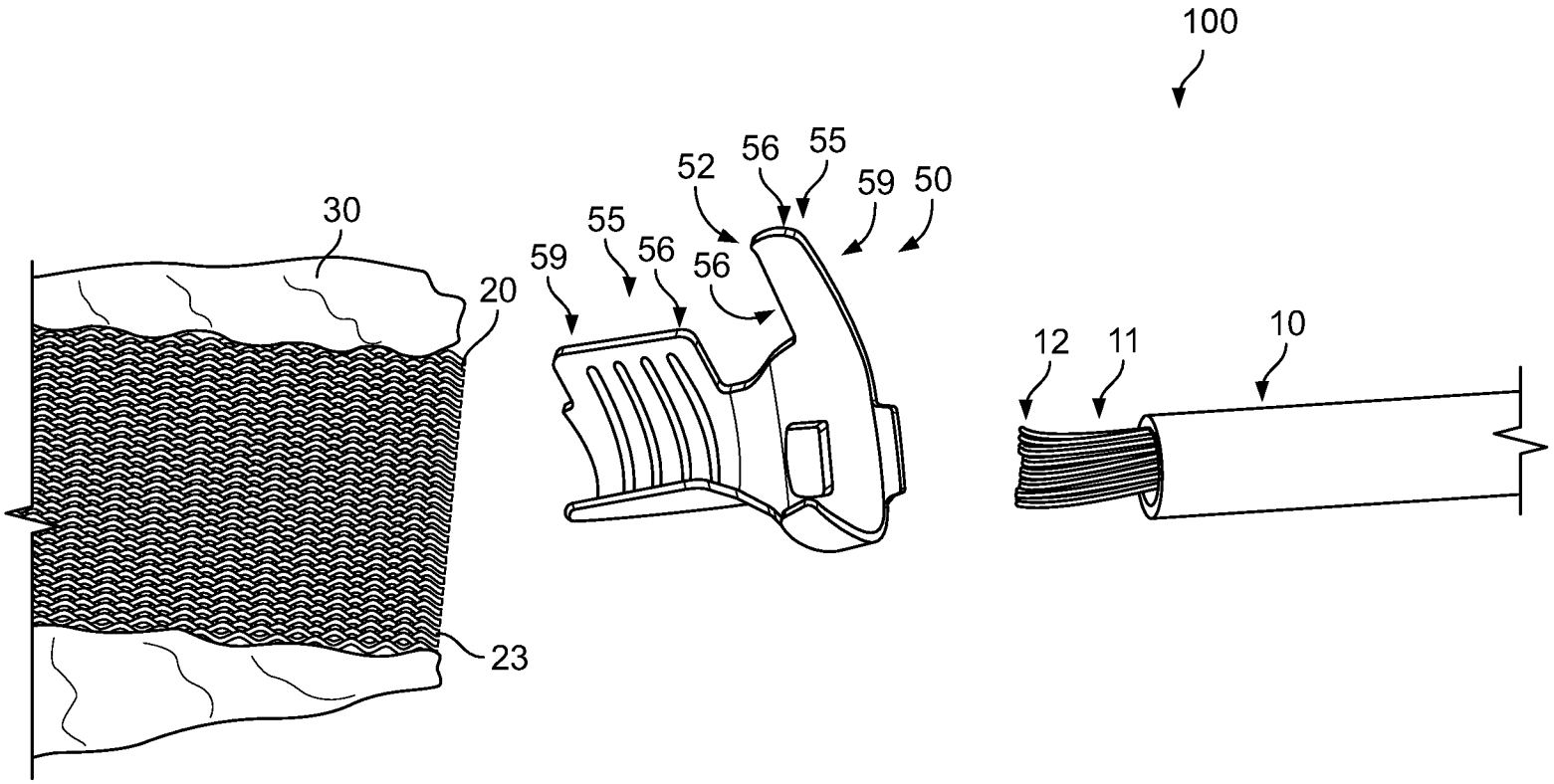
FIG. 9 is a perspective view of a set for an electrical connection assembly.
Figure 10:
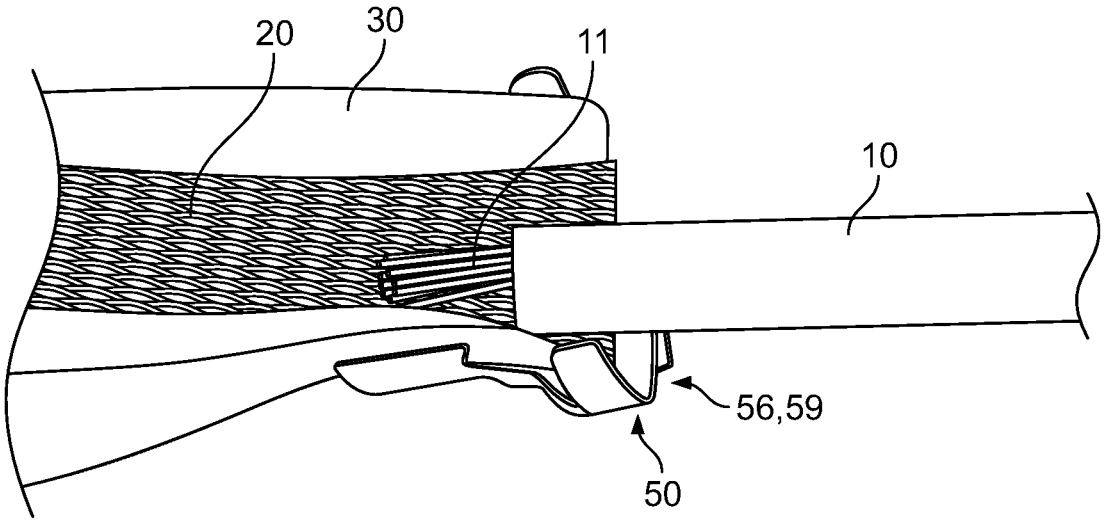
FIG. 10 is a perspective view of the set of FIG. 9 in a semi-assembled state.

In FIG. 9, a set for an electrical connection assembly 100 is shown. The set is in a non-deformed state and comprises a cable 10 with a conductor 11 comprising several single strands 12, a crimp element 50 with two crimp sections 55, and a metallic textile 20 attached to an insulating textile 30. As shown in FIG. 10, the conductor 11 of the cable 10 can be wrapped with the metallic textile 20 and inserted into the crimp element 50. In an embodiment, the conductor 11 is first joined with the metallic textile 20 and the combination of the two is then inserted into the receptacle 52 of the crimp element 50. For example, the conductor 11 can be placed next to or onto the metallic textile 20. Such an embodiment can be easy to process in an automatic manner. In an alternative, the metallic textile 20 is first inserted into the receptacle 52, and the conductor 11 is inserted subsequently.

Figure 11:
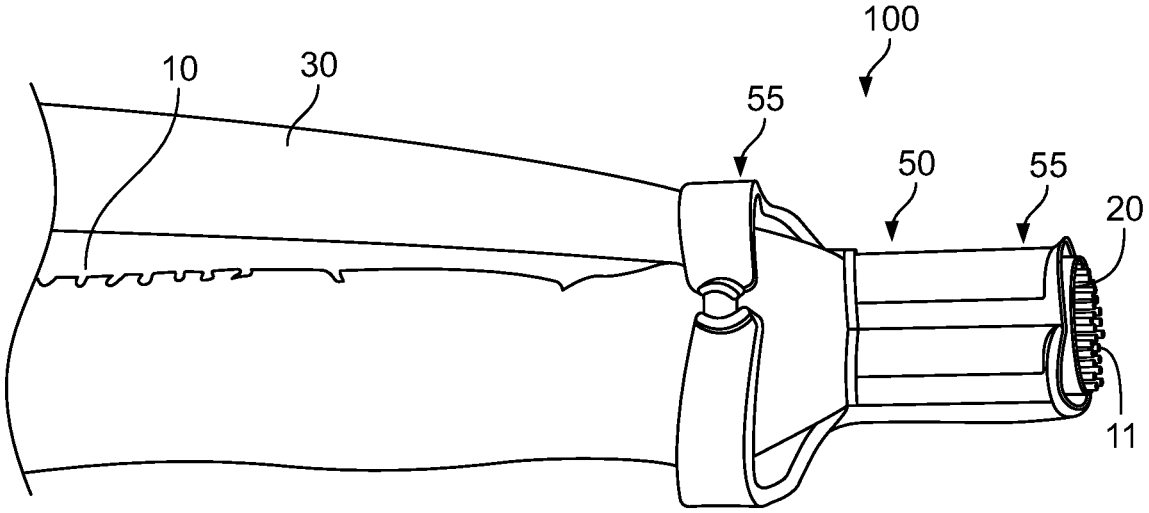
FIG. 11 is a perspective view of an electrical connection assembly according to another embodiment.

In FIG. 11, an electrical connection assembly 100 according to another embodiment, similar to the one produced from the embodiment of FIGS. 9 and 10, is shown. In this embodiment, however, the metallic textile 20, the insulating textile 30 and the cable 10 protrude to a same side away from the crimp element 50.

What is claimed is:

1. An electrical connection assembly, comprising:

a cable having a conductor;

a metallic textile in electrical contact with the conductor;

a crimp element creating a pressure between the conductor and the metallic textile; and an insulating textile located between the crimp element and the metallic textile, a plurality of conductors and a plurality of heating threads are woven into the insulating textile and connected to the metallic textile.

2. The electrical connection assembly of claim 1, wherein the metallic textile and the insulating textile are part of an electrical element.

3. The electrical connection assembly of claim 2, wherein the metallic textile and the insulating textile are part of a contact section of the electrical element.

4. The electrical connection assembly of claim 3, wherein the contact section includes a pair of contact areas, one contact area for a ground connector and one contact area for a voltage connection.

5. The electrical connection assembly of claim 2, wherein the electrical element is an electrical heating element and includes a heating section electrically connected to the metallic textile.

6. The electrical connection assembly of claim 1, wherein the insulating textile is mechanically interconnected with the metallic textile.

7. The electrical connection assembly of claim 1, wherein the crimp element surrounds the conductor and/or the metallic textile.

8. The electrical connection assembly of claim 1, wherein the crimp element has a crimp section with a pair of crimp flanks attached to a base, the crimp section defines a volume in which the electrical conductor, the metallic textile, and the insulating textile are disposed.

9. The electrical connection assembly of claim 1, wherein the metallic textile, the insulating textile, and the cable all protrude to a same side away from the crimp element.

10. A method of electrically connecting a conductor of a cable with a metallic textile, comprising:

providing a crimp element;

providing an insulating textile between the crimp element and the metallic textile, the metallic textile is located on and mechanically interconnected with the insulating textile;

cutting a plurality of slits into the insulating textile to form an end part of the metallic textile that is movable; and crimping the crimp element to press the conductor and the metallic textile into electrical contact.

11. The method of claim 10, further comprising inserting the metallic textile and the conductor into a receptacle of the crimp element prior to crimping.

12. The method of claim 11, further comprising joining the conductor with the metallic textile prior to inserting the metallic textile and the conductor into the receptacle.

13. The method of claim 10, further comprising bending the end part into a cylindrical shape and inserting the conductor into the cylindrical shape prior to crimping.

14. The method of claim 13, wherein the insulating textile forms an outer side of the cylindrical shape of the end part.

* * * * *